US006449820B2

(12) United States Patent
Tanaka et al.

(10) Patent No.: US 6,449,820 B2
(45) Date of Patent: Sep. 17, 2002

(54) SAMPLE WARPER AND WARPING METHOD

(75) Inventors: Yoshihiro Tanaka; Takatsugu Aihara, both of Kiryu (JP)

(73) Assignee: Suzuki Warper, Ltd., Gunma-ken (JP)

( * ) Notice: Subject to any disclaimer, the term of this patent is extended or adjusted under 35 U.S.C. 154(b) by 0 days.

(21) Appl. No.: 09/842,840

(22) Filed: Apr. 27, 2001

(30) Foreign Application Priority Data

Jun. 23, 2000 (JP) ..... 2000-189881

(51) Int. Cl.[7] ..... D02H 13/12
(52) U.S. Cl. ..... 28/200; 28/190
(58) Field of Search ..... 28/190, 195, 191, 28/193, 196, 192, 184, 200; 139/450, 452, 453

(56) References Cited

U.S. PATENT DOCUMENTS 4,972,562 A * 11/1990 Tanaka et al. ..... 242/472.8
5,590,448 A * 1/1997 Lenzen et al. ..... 28/191
5,950,289 A * 9/1999 Tanaka ..... 28/184
6,233,798 B1 * 5/2001 Bogucki-Land ..... 28/190

FOREIGN PATENT DOCUMENTS

EP 0 375 480 A2 6/1990
EP 0 933 455 A2 8/1999

* cited by examiner

*Primary Examiner*—Danny Worrell
(74) *Attorney, Agent, or Firm*—Arent Fox Kintner Plotkin & Kahn

(57) ABSTRACT

There is provided a sample warper which comprises a warper drum, a plurality of conveyor belt, conveyor belt feed means, a plurality of yarn introduction means, a plurality of yarn selection means, a plurality of shedding means, and creel means for supporting a plurality of bobbins, wherein the feed rate of the conveyor belt can be changed in accordance with the number of yarns to be warped simultaneously on the basis of preset warping conditions and warping designs. Accordingly, undulation can be prevented from occurring on a surface of wound yarns due to change in the number of the yarns to be warped simultaneously.

4 Claims, 6 Drawing Sheets

SAMPLE WARPER AND WARPING METHOD

BACKGROUND OF THE INVENTION

1. Field of the Invention

The present invention relates to a sample warper and a warping method where a feed rate of a conveyor belt is controlled according to the number of yarns which are warped simultaneously and undulation can be prevented from occurring on a surface of warped yarns which have been wound on a warper drum due to variation of the number of yarns to be warped simultaneously.

2. Description of the Related Art

As a conventional sample warper (W), there has been known a structure shown in FIGS. 4–6, disclosed in Japanese Patent No. 1529104, etc. The sample warper W of FIG. 4 comprises: a warper drum (A); a single yarn introduction means 6, rotatably mounted on one side surface of the warper drum (A) for winding a yarn on the warper drum (A); a plurality of yarn selection guides 27 associated with the yarn introduction means 6 and mounted on an end of a base (Y) supporting the warper drum (A) for moving angularly movable to project to a yarn exchanging position and retract to a standby position during yarn changing; a fixed creel (B) for supporting a plurality of bobbins (N) which are associated with the plural yarn selection guides 27 and on which the same kind or different kinds of yarns 22 are to be wound, thereby passing the yarns 22 between the yarn introduction means 6 and the yarn selection guides 27 so that the yarns are automatically changed and successively wound neatly on the warper drum (A) according to preset pattern data(yarn order).

In the sample warper (W), the plural yarn selection guides 27 receive the plural yarns 22, respectively, so that the individual yarns 22 of the fixed creel (B) can be successively wound on the warper drum W in a fully controlled manner. Reference numeral 17 designates a plurality of conveyer belts movably mounted on a circumferential surface of the warper drum (A). A feed rate of the conveyor belt 17 is controlled by a conveyor belt feed means, that is, a conveyor belt feed motor later described. A plurality of parallel shedding members (a plurality of parallel shedding bars 38*a*–38*g*) longitudinally extending alongside of the warper drum (A).

This known sample warper (W) has a hollow shaft 1 (FIG.5). Driving and driven shafts 2, 3 project centrally from opposite ends of the hollow shaft 1. A small gear 5 fixed to a pulley 4 and a pulley 99 are loosely mounted on the driving shaft 2, while a small gear 7, to which a yarn introduction means 6 is fixed, is loosely mounted on the driven shaft 3 at the distal end. While the illustrated example shows only one yarn introduction means 6, two or more yarn introduction means 6 must be disposed for a plural-winding system as shown in Japanese Patent No. 1767067, EP 0375480 and U.S. Pat. No. 4,972,562.

The small gears 5, 7 are associated with each other through small gears 9, 10 disposed at opposite ends of an associating shaft 8 extending through the hollow shaft 1, which small gears 9, 10 are meshed with the corresponding small gears 5, 7. The hollow shaft 1 is cantilevered at the driving shaft 2, and a warper drum A is loosely mounted on the hollow shaft 1 on the driven shaft 3 side.

The warper drum (A) is formed of drum frames 13, 14 having an outer periphery of like shape having alternately an arcuate portion and a straight portion; a pair of rollers 15 disposed one on the arcuate portion of each of the drum frames 13, 14; and horizontal beams 16 carrying the rollers 15 around which conveyor belts 17 are wound. The conveyor belts 17 are moved along a plane formed by the horizontal beams 16.

The conveyer belts 17 are simultaneously driven to a common amount of fine movement by a drive member 21 threadedly engaged with interior screw shafts 20 of planetary gears 19 concurrently rotated by meshing with a sun gear 18 suitably driven from the exterior. A feed rate of the conveyor belt 17 may be controlled by a control unit controlling a conveyor belt moving motor 51 later described, that is, a conveyor belt feed means. The distal end of the yarn introduction means 6 is bent inwardly to provide a yarn introducing member 6 which is disposed adjacent to the front end of the outer periphery of the warper drum (A).

Referring to FIG. 5, (B) designates a fixed creel for supporting a plurality of bobbins around which different kinds (different colors or different twists) of yarns 22 are wound; 24, a guide plate for guiding yarns 22 drawn out from the bobbins; 25, a tension regulator for regulating the tension of the yarns 22; 26, a dropper ring; 30, a guide rod for the yarns 22; and (E), a yarn fastener having a permanent magnet mounted to a base (Y) for pressing and setting the yarns.

Referring again to FIG. 5, reference numeral 46 designates a main motor implemented by an invertor motor for enabling, during operation of the warper, acceleration and deceleration, buffer start/stop, jogging operation and an increased winding speed.

Further in FIG. 5, reference numeral 47 designates a main speed change pulley; 58, a V belt wound on and between the main speed change pulley 47 and an auxiliary speed change pulley 48; 49, a counter pulley which is coaxial with the auxiliary speed change pulley 48; and 50, a brake actuating pinion for reciprocatingly moving a rack to bring the rack into and out of engagement with a brake hole (not shown) in a brake drum (D), thus controlling the warper drum (A) as desired. Reference numeral 57 designates a belt between pulleys 4 on the driving shaft 2; 51, a conveyor belt moving motor (AC servo motor); 52, a shift lever; 54 a sprocket-wheel; 55, a chain; 56, a chain wheel for driving the sun gear 18; 57, 58, both V belts; 59, a front cover; 59*a*, a front guide rod; and (D), the brake drum. Reference numerals 67*a*, 67*b* designate sensors for detecting the passing of the slit of the slitted plate 28.

Referring next to FIG. 6, reference numeral 69 designates a movement/stopping change-over lever for the conveyor belts 17; 70, a locking lever for locking the warper drum (A); 74, a shedding bar adjusting lever; 75, a shedding bar locking handle; 78, a program setting unit; 79, a controller; 80, a yarn tensioning unit located centrally on the straight part 12 of the warper drum (A); and (C), a rewinder.

The controller 79 is a control unit for controlling the sample warper and may control various apparatus connected thereto in accordance with a program set by a program setting unit 78. The basic structure and operation of the sample warper (W) are well known as by the above-mentioned Japanese Patent, etc., so their detailed description is omitted here. As the conveyor belt 17, needless to say, there may be applied an endless conveyor belt mechanism as disclosed in Japanese Patent Laid-open Publication No. 11-315439.

The conveyor belt feed means in the sample warper has been known, for example, in Japanese Patent No. 1529104. For reference, the feed means will be described below. Since the number of yarns which are simultaneously wound on the warper drum (A) is limited to only one, the feed rate ($P_1$) of the conveyor belt 17 corresponding to one revolution of the yarn introduction means 6 is calculated according to the conditions (the warping width, the total number of yarns to be warped, and the number of warping windings) input in advance by the following equation (2) and the motor 51 for conveyor belt feed (AC servomotor) is controlled on the basis of the calculated value to move the conveyor belt 17 in the same pitch until warping operations corresponding to the number of yarns to be warped are completed.

$$P_1 = \frac{\text{warping width}}{\text{the number of yarns to be warped} \times \text{the number of warping windings}} \quad (2)$$

For example, in Japanese Patent No. 1767706, EP 0375480 and U.S. Pat. No. 4,972,562, there has been disclosed a sample warper where a plurality of yarns can be warped simultaneously using a rotary creel. Since the simultaneous warping of the plurality of yarns in the sample warper is performed through repetition warping based on the number of bobbins set in the rotary creel, when the warping conditions (the warping width, the total number of yarns to be warped and the number of warping windings) is input, the value obtained by (the total number of yarns to be warped) ÷(the number of yarns to be warped simultaneously) is input in advance as the number of yarns to be warped, the feed rate ($P_1$) of the conveyor belt per revolution of the yarn introduction means is calculated using the above-mentioned equation (2), and a motor for conveyor belt feed (AC servomotor) is controlled on the basis of the calculated value so that the conveyor belt is moved at the same pitch until the warping operation of the total number of the yarns to be warped is completed.

Also, in Japanese Patent Laid-open Publication 2000-136456 and U.S. Pat. No. 6,173,480, the present inventor has proposed a sample warper where the arts of the above-mentioned Japanese Patent Nos. 1529104 and 1767706 are combined with each other and it is made possible to perform yarn selection from yarns set to a rotary creel so that pattern warping with a combination of a repetition warping and a pattern warping can be performed in a short time.

Also, in Japanese Patent Application No. 2000-76720, the present inventor has proposed a sample warper where yarn selection on a rotary creel and bobbin selection can be performed and simultaneous pattern warping using only the rotary creel can be performed even when a complicated pattern warping is performed.

However, in the two proposed sample warpers, since warping is not performed with the predetermined number of yarns to be warped simultaneously to the end but the number of yarns to be warped simultaneously always varies, it is required to perform warping while a feed rate of a conveyor belt is being changed according to the number of yarns to be warped simultaneously, which is different from the sample warpers which have been disclosed in the above-mentioned Japanese Patent Nos. 1529104 and 1767706.

SUMMARY OF THE INVENTION

With the foregoing drawbacks of the prior art in view, it is an object of the present invention is to propose a sample warper and a warping method where a feed rate of a conveyor belt can be controlled according to the number of yarns to be warped simultaneously, thereby preventing undulation from occurring on a surface of yarns, which have been wound on a warper drum due to variation of the number of yarns to be warped simultaneously.

To attain the foregoing object, a sample warper of the present invention comprises: a warper drum; a plurality of conveyor belts rotatably provided on a side face of the warper drum and moving on the warper drum at a predetermined feed rate; conveyor belt feed means for controlling the feed rate of the conveyor belt; a plurality of yarn introduction means each mounted to a side surface of the warper drum for winding a yarn on the conveyor belts; a plurality of yarn selection means arranged in one end portion of a base for supporting the warper drum; a plurality of shedding means provided in parallel to the longitudinal direction of the warper drum; and creel means for supporting a plurality of bobbins, wherein the feed rate of the conveyor belt can be changed according to the number of yarns to be warped simultaneously on the basis of predetermined warping conditions and warping designs. As the above creel means, only a rotary creel may be used, and both a rotary creel and a fixed creel may be used.

It is preferable that the control of the feed rate of the conveyor belt is performed such that a feed pitch of the conveyor belt per revolution of the yarn introduction means is calculated according to the following equation (1):

$$P=J/[(K/L)\times M] \quad (1)$$

where P is the feed pitch of the conveyor belt per revolution of the yarn introduction means, J is a warping width, K is the total number of yarns to be warped, L is the number of yarns to: be warped simultaneously, and M is the number of warping windings.

In a warping method of the present invention, there is used a sample warper where one yarn is set to each of a plurality of yarn introduction means and a plurality of yarns are wound on a conveyor belt moving on a warper drum at a predetermined feed rate, and the feed rate of the conveyor belt is controlled in accordance with the number of yarns to be warped simultaneously.

It is preferable that the control of the feed rate of the conveyor belt is performed such that a feed pitch of the conveyor belt per revolution of the yarn introduction means is calculated according to the following equation (1):

$$P=J/[(K/L)\times M] \quad (1)$$

where P is the feed pitch of the conveyor belt per one revolution of the yarn introduction means, J is a warping width, K is the total number of yarns to be warped, L is the number of yarns to be warped simultaneously, and M is the number of warping windings.

The gist of the present invention lies in that, when warping conditions (warping width, the number of yarns to be warped, and the number of warping windings) and a pattern design are input in a setting device (a personal computer loaded with a software which has been developed for a sample warper), the number of yarns to be warped simultaneously is input to calculate a feed rate of a conveyor belt according to the above equation (1) and store the same in the setting device; and when data in the setting device is transmitted as warping information and pattern information to a controller for a sample warper, information about a feed rate of a conveyor belt is also transmitted to calculate the number of pulses for controlling an AC servomotor which is a drive motor for the conveyor belt by the controller for a sample warper and control the AC servomotor according to warping advance, thereby making it possible to perform conveyor belt feed per one revolution of the yarn introduction means so as to conform with warping for different numbers of yarns to be warped simultaneously.

DETAILED DESCRIPTION OF THE PREFERRED EMBODIMENTS

Embodiments of the present invention will be explained below with reference to the accompanying drawings. These embodiments are merely illustrative, and the present invention may be modified or changed variously without departing from the scope or spirit of the technical idea of the present invention or the appended claims.

Figure 1:
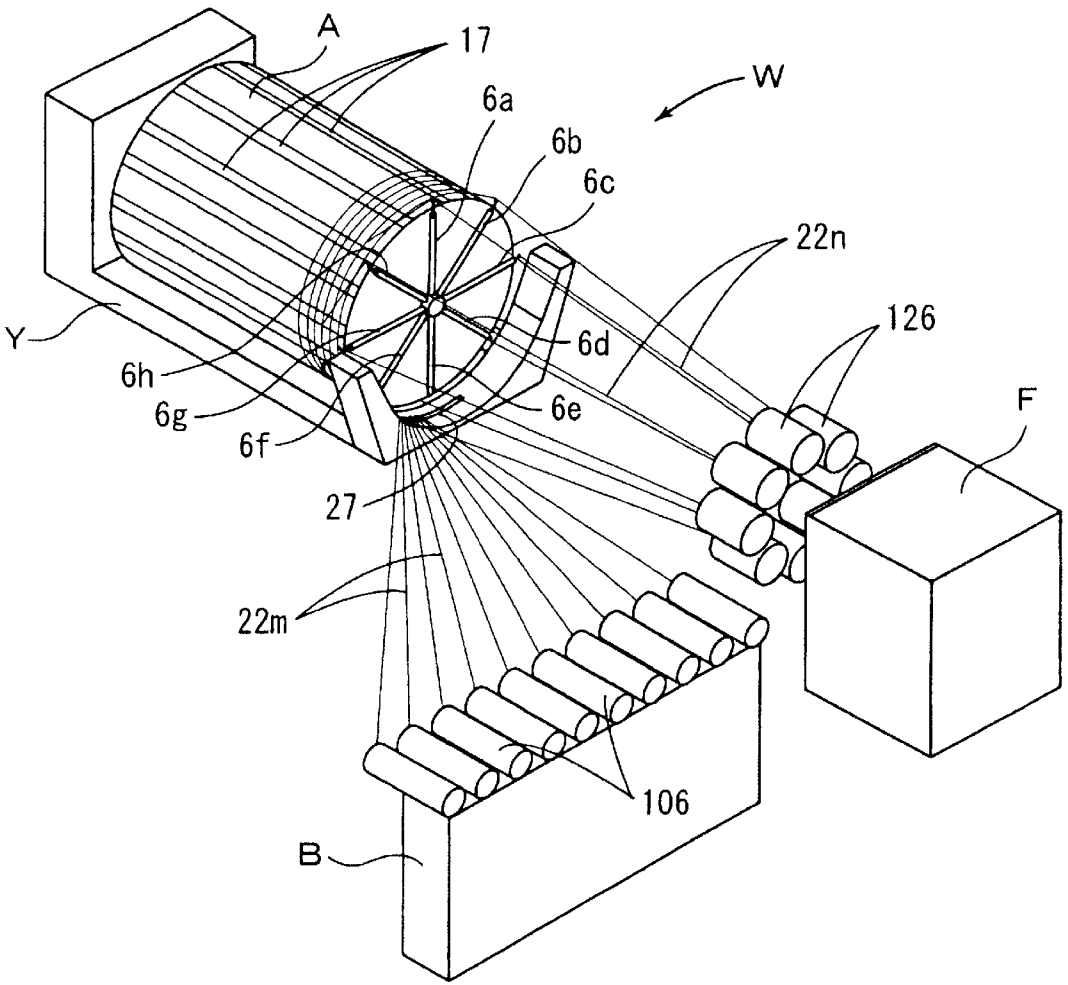
FIG. 1 is a schematic perspective view of an embodiment of a sample warper according to the present invention.

FIG. 1 shows an embodiment of a sample warper (W) of an embodiment according to the present invention. The sample warper (W) comprises: a warper drum (A); a plurality of conveyor belts 17 rotatably provided on a side face of the warper drum (A) and moving on the warper drum (A) at a predetermined feed rate; a plurality of yarn selection means, or yarn selection guides 27, associated with the yarn introduction means 6 and mounted on an end of a base (Y) supporting the warper drum (A) for moving angularly movable to project to a yarn exchanging position and retract to a standby position during yarn changing; a fixed creel (B) for supporting a plurality of, bobbins 106 which are associated with the plural yarn selection guides 27 and on which the same kind or different kinds of yarns 22*m* are to be wounded, and a rotary creel F for supporting a plurality of bobbins 126 which are associated with the plural yarn selection guides 27 and on which the same kind or different kinds of yarns 22*n* are to be wounded, thereby passing the yarns 22*m*, 22*n* between the yarn introduction means 6*a*~6*h* and the yarn selection guides 27 so that the yarns 22*m*, 22*n* are automatically changed and successively wound neatly on the warper drum (A) according to preset yarn order.

Thus, the sample warper (W) is structured such that the yarns 22*m* of the fixed creel B and the yarns 22*n* of the rotary creel F are respectively stored in the plurality of the yarn selection guides 27, and both the yarns 22*m* of the fixed creel B and the yarns 22*n* of the rotary creel F can be used so that the yarns 22*m* of the fixed type creel B and the yarns 22*n* of the rotary creel F are sequentially wound on the warper drum B as the need arises.

Reference numeral 17 denotes a conveyor belt which is movably provided on a peripheral surface on the warper drum (A). Also, a plurality of shedding means (not shown) are provided in parallel to each other along the longitudinal direction of the warper drum (A). Incidentally, the basic structure and operation of the sample warper (W) are well-known in the above-mentioned patents and the like and therefore detailed explanation thereof will be omitted.

Figure 2:
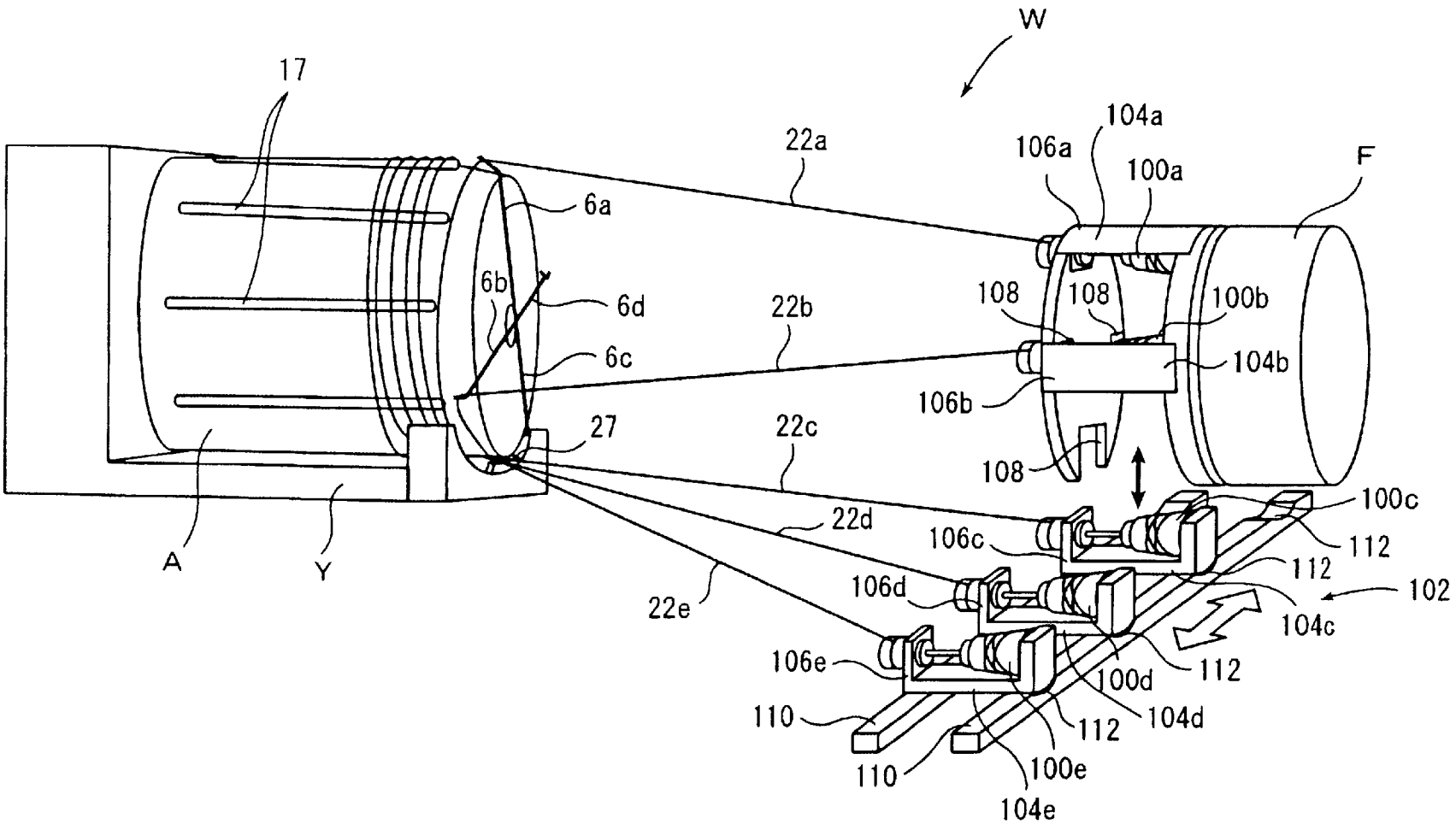
FIG. 2 is an entire explanatory view schematically showing another embodiment of a sample warper according to the present invention.

FIG. 2 shows a sample warper of another embodiment used in the present invention. In FIG. 2, the same or similar parts or members as those in FIG. 1 are denoted by the same reference numerals used in FIG. 1. The sample warper (W) in FIG. 2 comprises a plurality of (4 in the illustrated embodiment) yarn introduction means 6*a* to 6*d* which are rotatably provided on a side face of a warper drum (A) and which wind yarns 22*a* to 22*e* on the warper drum (A), and a plurality of yarn selection means, or yarn selection guides 27, which are provided on one end portion of a base stand (Y) supporting the warper drum (A) so as to correspond to the yarn introduction means 6*a* to 6*d* and which are rotated and protruded to yarn exchange positions at a time of yarn exchange and are rotated and accommodated to standby positions at a time of yarn accommodation, wherein delivery of the yarns 22*a* to 22*e* is performed between the yarn introduction means 6*a* to 6*d* and the yarn selection guides 27 so that yarn exchange of the yarns 22*a* to 22*e* is automatically performed according to the set yarn order to wind the yarns on the warper drum (A).

In the sample warper (W), a rotary creel F supporting a plurality of (5 in the illustrated embodiment) bobbins 100*a* to 100*e* on which different kinds and/or the same kind of yarns 22*a* to 22*e* are wound and a bobbin station 102 supporting the bobbins 100*a* to 100*e* in a standby state are respectively provided so as to correspond to the plurality of yarn selection guides 27.

In FIG. 2, reference numeral 17 denotes a conveyor belt which is rotatably set on a peripheral surface of the warper drum (A). A plurality of shedding means 38*a* to 38*g* are provided in parallel to each other along the longitudinal direction of the warper drum (A). The illustration of the shedding means are omitted.

The characteristic structure of this sample warper (W) lies in that the bobbins 100*a* to 100*e* can detachably be mounted to the rotary type creel F and the bobbin station 102, respectively, and the bobbins 100*a* to 100*e* can be transferred from the rotary type creel F to bobbin station 102 and vice versa.

In FIG. 2, reference numerals 104*a* to 104*e* denote bobbin bodies, which are respectively formed by mounting the bobbins 100*a* to 100*e* to bobbin frames 106*a* to 106*e*, so that attaching/detaching work of the bobbins 100*a* to 100*e* can be made easy. The basic structure of the rotary creel (F) is generally the same as that of a conventional well-known one. The rotary creel (F) is provided at a front portion with a plurality of (4 in the illustrated embodiment) bobbin receiving recess portions 108, and the bobbin bodies 104*a* to 104*e* are detachably mounted to the bobbin receiving recess portions 108.

The above bobbin station 102 is enough required to be structured so as to retain the plurality of bobbin bodies 104*a* to 104*e* detachably in a standby position, and it is not limited to any specific structure. In the embodiment shown in FIG. 2, however, a plurality of (4 in the illustrated embodiment) of bobbin receiving portions 112 are formed on two rail members 110, 110 opposed to each other, and the bobbin bodies 104*a* to 104*e* are detachably mounted to the bobbin receiving portions 112.

The bobbin station 102 (the rail members 110 in the illustrated embodiment) is structured to be movable, thereby facilitating the passing work of the bobbin bodies 104*a* to 104*e* between the rotary creel F and the bobbin receiving recess portions 108. Also, it is preferable that the passing work of the bobbin bodies 104*a* to 104*e* is automatically performed by a known robot hand or the like according to preset pattern data (yarn order).

The present invention will be explained in detail below through explanation of Examples.

EXAMPLE 1

Warping was performed under the following conditions using a sample warper as shown in FIG. 1.

Warping conditions:

Warping width: 180 cm,

The total number of yarns to be warped: 3600

The number of warping windings: 12 times

TABLE 1

| Warping designs | | | |
|---|---|---|---|
| Yarn kinds | Warping designs | | |
| 101 | 16 | 32 | 16 |
| 102 | 4 | | |
| 103 | | 4 | |

Table 1 means a warping design that the number of yarns of yarn kind 101 is 16, the number of yarns of yarn kind 102 is 4, the number of yarns of yarn kind 101 is 32, the number of yarns of yarn kind 103 is 4, and the number of yarns of yarn kind 101 is 16, and therefore the total number of yarns is 72. The design is repeated until the number of yarns to be warped reaches 3600.

In a case of the above warping, such operation can be employed that the yarns of the yarn kind 101 is warped by a rotary creel, and the yarns the remaining yarn kinds 102, 103 are warped by a fixed creel. Also, when the portion of the yarns of the yarn kind 101 is warped with 8 yarns at once, the warping time can be shortened. Here, 8 bobbins are prepared for the yarn kind 101 and 8 yarns are warped simultaneously in the rotary creel (because the maximum number of yarns which can be simultaneously warped by the rotary creel is 8 in the sample warper of FIG. 1).

8 bobbins for the yarn kind 101 are set on the rotary creel, and the yarns are pulled out from the bobbins to be set to yarn selection guides No. 1 to No. 8 of the yarn selection means for the rotary creel. Also, one bobbin for the yarn kind 102 and one bobbin for the yarn kind 103 are set on the fixed creel, and the yarns are pulled out from the bobbins to be set to yarn selection guides No. A and No. B. In a display screen of a personal computer shown in FIG. 3, since yarn selection guides No. A to No. J of the yarn selection means are displayed as yarn kinds, the yarn kind 102 and the yarn kind 103 will be explained below as the yarn kind A and the yarn kind B, respectively.

Figure 3:
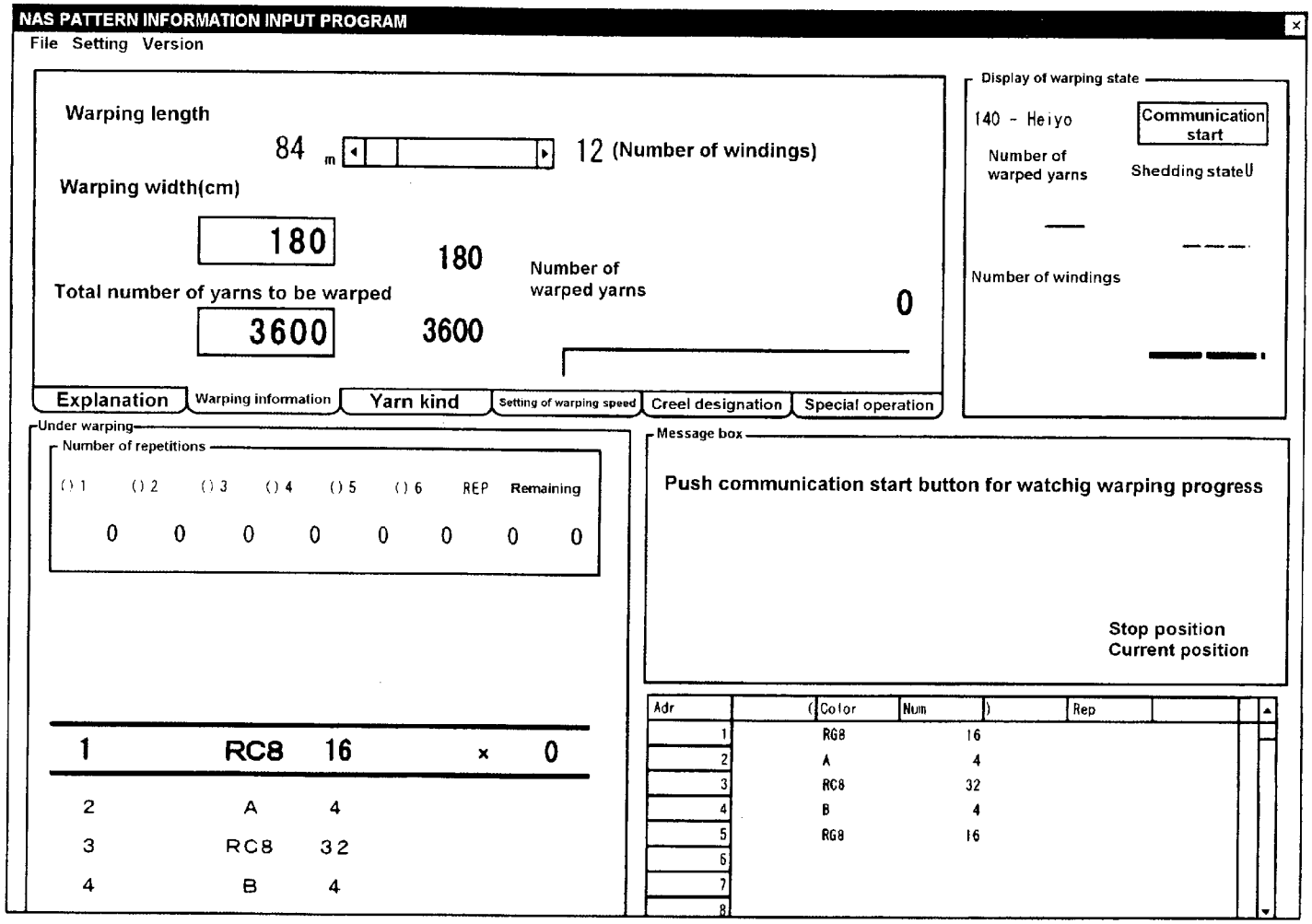
FIG. 3 is a screen view of a display of a setting device showing warping information input in Example 1.
Figure 4:
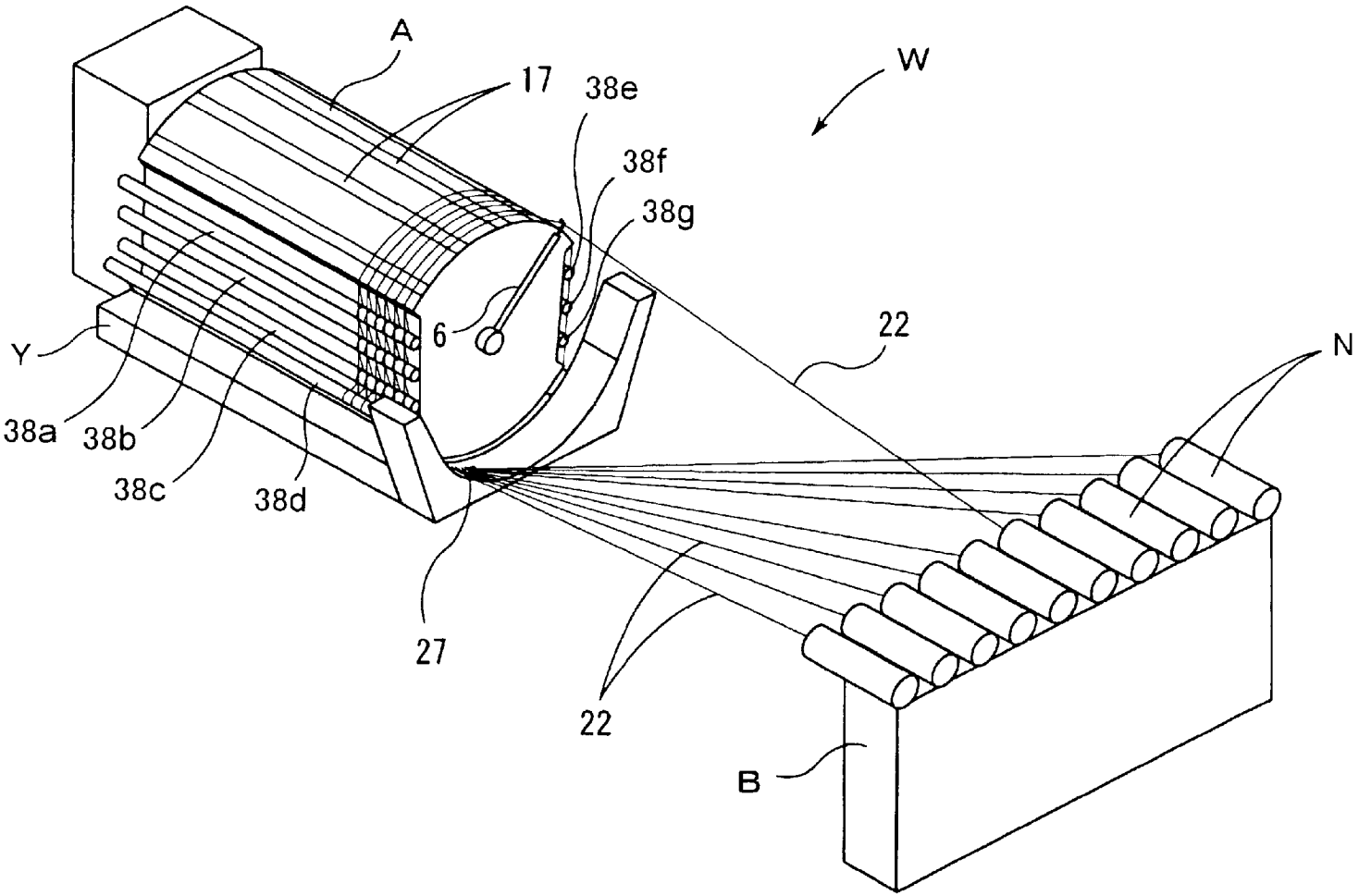
FIG. 4 is a perspective explanatory diagram showing a conventional sample warper.
Figure 5:
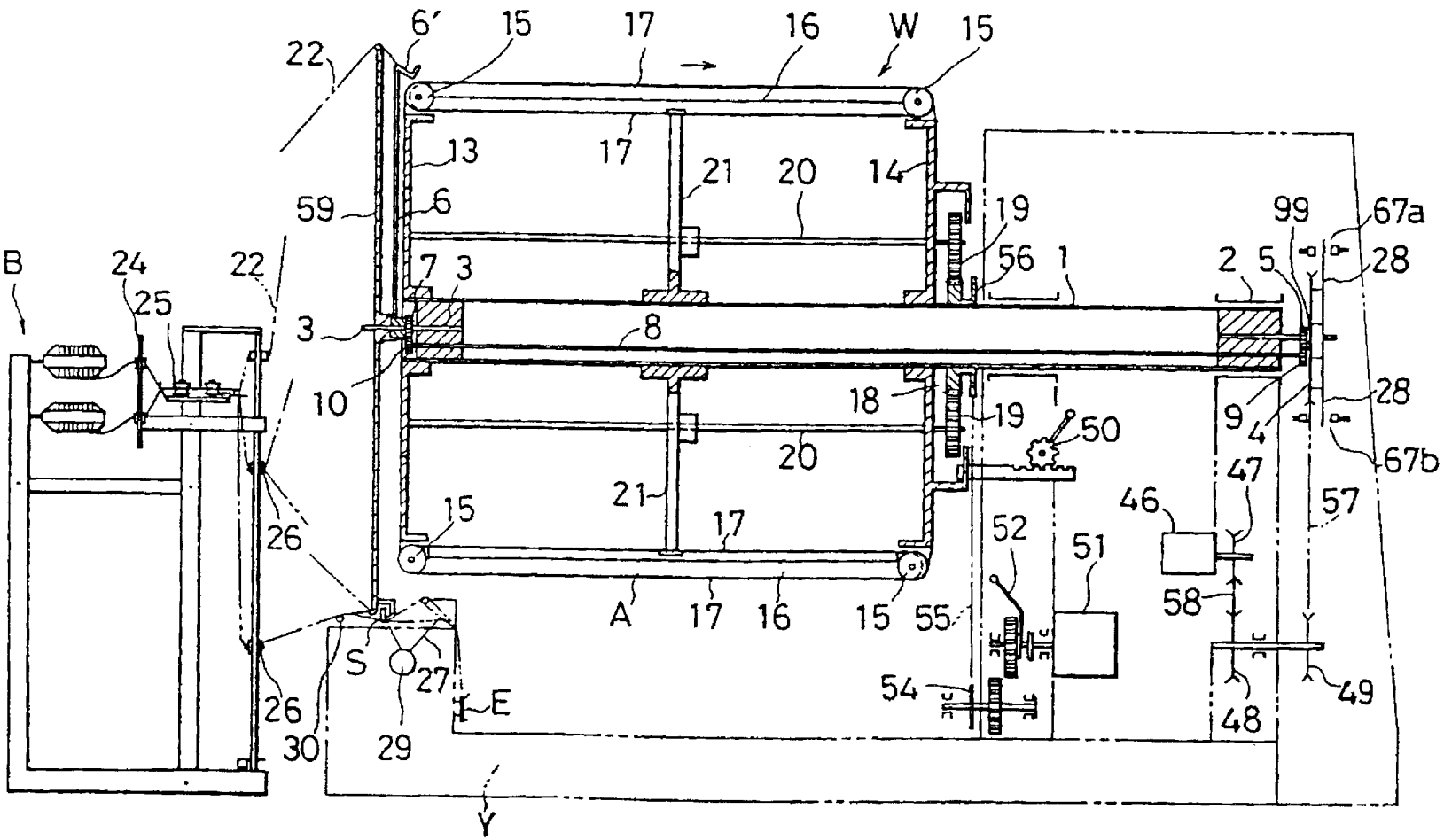
FIG. 5 is a schematic cross-sectional view of the conventional sample warper illustrated in FIG. 4.
Figure 6:
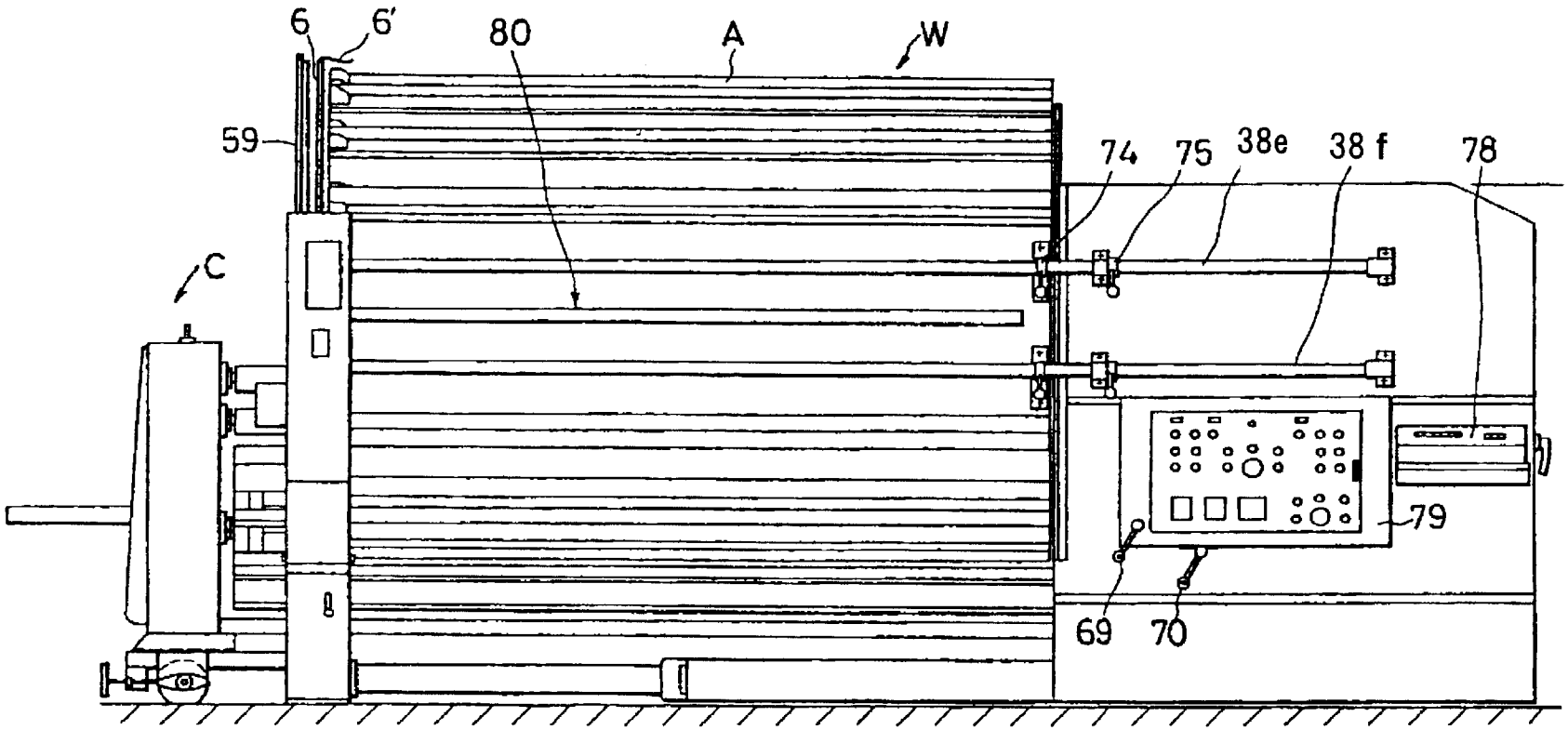
FIG. 6 is a schematic lateral view of the conventional sample warper illustrated in FIG. 4.

The warping width: 180 cm, the number of yarns to be warped: 3600, and the number of warping windings: 12 are input as the warping conditions into the setting device. Then, the warping design is input as follows:

"RC 8" is input into the yarn kind column (displayed as color) for the address 1 (displayed as Adr in the screen) and "16" is input into the number column (displayed as Num) as the warping design. "A" is input into the yarn kind column for the address 2 and "4" is input into the number column. "RC 8" is input into the yarn kind column for the address 3 and "32" is input into the number column. "B" is input into the yarn kind column for the address 4 and "4" is input into the number column. "RC8" is input into the yarn kind column for address 5 and "16" is input into the number column. The input warping information is displayed such as shown in FIG. 3. The "RC 8" in the above-mentioned yarn kind column means designations of the rotary creel and the number of yarns to be simultaneously warped, each of the "A" and "B" in the yarn kind column means the designation of the fixed creel and that the number of yarns to be simultaneously warped is one.

For performing warping of the address 1, the feed rate of the conveyor belt per revolution of the yarn introduction means is calculated according to the above-mentioned equation (1) on the basis of this warping information so that 0.333 mm is obtained.

For performing warping of the address 2, the feed rate of the conveyor belt per revolution of the yarn introduction means is calculated so that 0.041 mm is obtained. For performing warping of the address 3, the feed rate of the conveyor belt per revolution of the yarn introduction means is calculated so that 0.333 mm is obtained.

For performing warping of the address 4, the feed rate of the conveyor belt per revolution of the yarn introduction means is calculated so that 0.041 mm is obtained. For performing warping of the address 5, the feed rate of the conveyor belt per revolution of the yarn introduction means is calculated so that 0.333 mm is obtained.

When the warping information is transferred from the setting device to the main body of the warper, not only the warping conditions and the pattern data but also the feed rate of the conveyor belt are transferred to the controller as the warping information. In the controller, the number of pulses for controlling the AC servomotor is calculated from the feed rate of the conveyor belt and the calculated value is stored. When warping starts, the feed rate of the conveyor belt is controlled so as to correspond to advance of the warping.

In a case of simultaneous warping of 8 yarns, the conveyor belt feed of 0.333 mm per revolution of the yarn introduction means is achieved, and in a case of simultaneous warping of 1 yarn, the conveyor belt feed of 0.041 mm of the conveyor belt per revolution of the yarn introduction means is achieved to proceed with the warping.

Undulation has been prevented from occurring, on the surface of the yarns wound due to change in the number of yarns to be warped simultaneously. Also, it is possible to perform a similar warping by the sample warper shown in FIG. 2.

As stated above, according to the present invention, a feed rate of a conveyor belt can be controlled according to the number of yarns to be warped simultaneously, thereby preventing undulation from occurring on a surface of yarns which have been wound on a warper drum due to variation of the number of yarns to be warped simultaneously.

Obviously various minor changes and modifications of the present invention are possible in the light of the above teaching. It is therefore to be understood that within the scope of the appended claims the invention may be practiced otherwise than as specifically described.

What is claimed is:

1. A sample warper comprising:

a warper drum;

a plurality of conveyor belts rotatably provided on a side face of the warper drum and moving on the warper drum at a feed rate;

conveyor belt feed means for controlling the feed rate of the conveyor belt;

a plurality of yarn introduction means each mounted to a side surface of the warper drum for winding a yarn on the conveyor belts;

a plurality of yarn selection means arranged in one end portion of a base supporting the warper drum;

a plurality of shedding means provided in parallel to the longitudinal direction of the warper drum;

creel means for supporting a plurality of bobbins, and means for changing the feed rate of the conveyor belt during operation of the sample warper in accordance with the number of yarns to be warped simultaneously on the basis of preset warping conditions and warping designs.

2. A sample warper according to claim 1, wherein the control on the feed rate of the conveyor belt is performed such that a feed pitch of the conveyor belt per revolution of the yarn introduction means is calculated according to the following equation (1):

$$P=J/[(K/L)\times M] \quad (1)$$

where P is the feed pitch of the conveyor belt per revolution of the yarn introduction means, J is a warping width, K is the total number of yarns to be warped, L is the number of yarns to be warped simultaneously, and M is the number of warping windings.

3. A warping method comprising the steps of:

preparing a sample warper having a warper drum where one yarn is set to each of a plurality of yarn introduction means, winding a plurality of yarns on a conveyor belt moving on the warper drum at a feed rate, and changing the feed rate of the conveyor belt during operation in accordance with the number of yarns to be warped simultaneously.

4. A warping method according to claim 3, wherein the control on the feed rate of the conveyor belt is performed such that a feed pitch of the conveyor belt per revolution of the yarn introduction means is calculated according to the following equation (1):

$$P=J/[(K/L)\times M] \quad (1)$$

where P is the feed pitch of the conveyor belt corresponding to one revolution of a yarn introduction means, J is a warping width, K is the total number of yarns to be warped, L is the number of yarns to be warped simultaneously, and M is the number of warping windings.

* * * * *